US005974946A

United States Patent [19]

Kanou et al.

[11] Patent Number: 5,974,946

[45] Date of Patent: Nov. 2, 1999

[54] SWASH PLATE TYPE COMPRESSOR USING SWASH PLATE MADE OF HIGHLY WEAR-RESISTANT MATERIAL

[75] Inventors: Hiroshi Kanou, Takasaki; Eiji Fukushima, Seta-gun, both of Japan

[73] Assignee: Sanden Corporation, Gunma, Japan

[21] Appl. No.: 08/975,361

[22] Filed: Nov. 20, 1997

[30] Foreign Application Priority Data

Nov. 21, 1996 [JP] Japan ..... 8-310847

[51] Int. Cl.[6] ..... F01B 3/00

[52] U.S. Cl. ..... 92/71

[58] Field of Search ..... 92/70, 71; 417/269

[56] References Cited

U.S. PATENT DOCUMENTS

| | | | |
|---|---|---|---|
| 2,709,339 | 5/1955 | Edelman et al. | 92/70 |
| 4,037,522 | 7/1977 | Inoshita et al. . | |
| 4,244,679 | 1/1981 | Nakayama et al. . | |
| 4,664,604 | 5/1987 | Terauchi . | |
| 5,056,417 | 10/1991 | Kato et al. | 92/71 |
| 5,382,139 | 1/1995 | Kawaguchi et al. . | |

FOREIGN PATENT DOCUMENTS

| | | |
|---|---|---|
| 0587023 | 3/1994 | European Pat. Off. . |
| 0740076 | 10/1996 | European Pat. Off. . |
| 0776986 | 6/1997 | European Pat. Off. . |
| 57-028881 | 2/1982 | Japan . |
| 2267371 | 1/1990 | Japan . |
| 3067069 | 3/1991 | Japan . |
| 8247021 | 9/1996 | Japan . |

*Primary Examiner*—F. Daniel Lopez
*Attorney, Agent, or Firm*—Baker & Botts, LLP

[57] ABSTRACT

A swash plate type variable-capacity compressor (3) includes a piston (23) with a piston rod (53) and a piston driving mechanism, the piston driving mechanism comprising a drive shaft (5), a swash plate (59) inclined and hinged with the drive shaft (5) to be rotatable together with the drive shaft (5) but being swingable on the drive shaft (5), and sliding shoes (79, 81) coupling the swash plate (59) to the piston rod (51) so as to reciprocate the piston (23) by rotation of the swash plate (59). In the compressor (3), the swash plate (59) is made of a copper alloy. Preferably, the copper alloy is at least one alloy selected from the group consisting of a high-strength brass alloy, a bronze alloy, and a lead-bronze alloy.

5 Claims, 2 Drawing Sheets

SWASH PLATE TYPE COMPRESSOR USING SWASH PLATE MADE OF HIGHLY WEAR-RESISTANT MATERIAL

BACKGROUND OF THE INVENTION

The present invention relates to a swash plate type compressor, and more particularly, to materials for a swash plate of a swash plate type compressor.

The swash plate type compressor is well known in the prior art and comprises a cylinder block having a plurality of cylinder bores formed in parallel with a cylinder axis and angularly spaced around the cylinder axis. A plurality of pistons are slidably fitted in the cylinder bores. A cylinder head having a suction chamber and a discharge chamber is mounted on one end of the cylinder block through a valve plate assembly so that each of the cylinder bores is connected to the suction chamber and the discharge chamber through a suction valve and a discharge valve mounted on the valve plate assembly. The cylinder block is also formed with a crank chamber adjacent the cylinder bores at the opposite side of the cylinder head end. In the crank chamber, a driving mechanism including a swash plate is disposed and drives the pistons to reciprocate in the cylinder bores. Reciprocation of the pistons sucks fluid such as refrigerant gas into the cylinder bores through the suction valve from the suction chamber and compresses and discharged the fluid to the discharge chamber through the discharge valve. Thus, fluid compression is carried out.

The driving mechanism comprises a drive shaft which is disposed in the crank chamber to extend on the cylinder axis and which is rotatably supported to the cylinder block. The swash plate is of a circular disk having a center hole and is disposed around the drive shaft which passes through the center hole but is inclined from the drive shaft by a predetermined slant or inclination angle. The swash plate is coupled to the drive shaft with a coupling mechanism and is thereby rotatable together with the drive shaft. Each of the pistons has a piston rod extending into the crank chamber in parallel with the cylinder axis. The piston rod is slidably connected to the outer periphery of the swash plate through sliding shoes. Thus, when the drive shaft rotates, each of the pistons are reciprocatively moved in the direction of the cylinder axis through the piston rod by the swash plate rotating together with the drive shaft.

Typical structures of the swash plate type compressor are disclosed in, for example, EP-A-0 587 023, U.S. Pat. No. 5,382,139, EP-A-0 740 076 and others. These documents disclose a variable capacity type compressor where the inclination angle of the swash plate is variable so as to regulate the displacement of the compressor. That is, when the slant angle is changed, the reciprocating stroke of the piston is also changed. Therefore, the displacement of the compressor is changed.

Although those documents discloses a structure where all of the cylinder bores are disposed at one side of the crank chamber, another structure is also known which is provided with another set of cylinder bores at the opposite side of the crank chamber with another set of pistons reciprocated within the set of cylinder bores by the same swash plate, as disclosed in, for example, JP-A-2 267371.

The swash plate type compressor, which can be provided with various structures as described above, is used for refrigerant compressor in an automotive air-conditioning system. In the application, the automotive engine output is utilized to drive the compressor. In detail, the engine output is selectively coupled with the drive shaft of the compressor through an electromagnetic clutch as is shown in FIG. 1 of EP-A-0 740 076.

In the swash plate type compressor, the swash plate and the sliding shoe are conventionally made of iron alloy. In specifically, the sliding shoe is made of bearing steel because it comes in sliding contact with the swash plate and the piston rod during operation of the compressor. On the other hand, since the outer peripheral portion or the sliding portion of the swash plate is in a sliding contact with the shoe, the surface of the sliding portion is coated with a coat of a copper-based bearing alloy so as to realize smooth sliding contact with the shoe. The copper-based bearing alloy coat is formed by sintering, thermal spraying, cladding, welding, or the like. After forming the coat, the coat is finished to obtain demanded accuracies in thickness and roughness.

However, the use of the copper-based bearing alloy coat on the swash plate makes the production process of the swash plate complicated and causes the cost of the swash plate increased. Further, the swash plate possibly suffers from a problem of peeling or separation at the interface between the iron based alloy and the copper-based bearing alloy.

In an application of the swash plate compressor for automotive air conditioning system using the electromagnetic clutch, the swash plate of the iron-based alloy is easily magnetized by magnetic flux from the electromagnetic clutch so that the compressor particularly has a disadvantage of damage or wear of the surfaces of the swash plate and shoes. This is because the swash plate magnetized attracts any iron powder caused by wear of any iron or iron alloy part or parts of the compressor, and the iron powder readily enters the clearances between the swash plate and the shoes.

SUMMARY OF THE INVENTION

It is an object of the present invention to provide a swash plate type compressor that allows a dramatic cost reduction by reducing the number of production steps of the swash plate.

It is another object of the present invention to provide a swash plate type compressor having a life time prolonged by making its swash plate wear-resistant.

According to the present invention, there is provided a swash plate type compressor which includes a piston with a piston rod and a piston driving mechanism, the piston driving mechanism comprising a drive shaft, a swash plate inclined on the drive shaft and rotated together with the drive shaft, and sliding shoes coupling the swash plate to the piston rod so as to reciprocate the piston by rotation of the swash plate, wherein the swash plate is made from a material of a copper alloy.

The copper alloy used for the swash plate is preferably at least one selected from a high-strength brass alloy, a bronze alloy, and a lead-bronze alloy. The swash plate is more preferably made of a special wear-resistant high-strength brass alloy. For example, a Cu-Mn-Si-Zn high-strength brass alloy can be used as the special wear-resistant high-strength brass alloy.

DESCRIPTION OF THE PREFERRED EMBODIMENTS

Now description will be made as regards a preferred embodiment of the present invention with reference to FIGS. 1 and 2.

Figure 1:
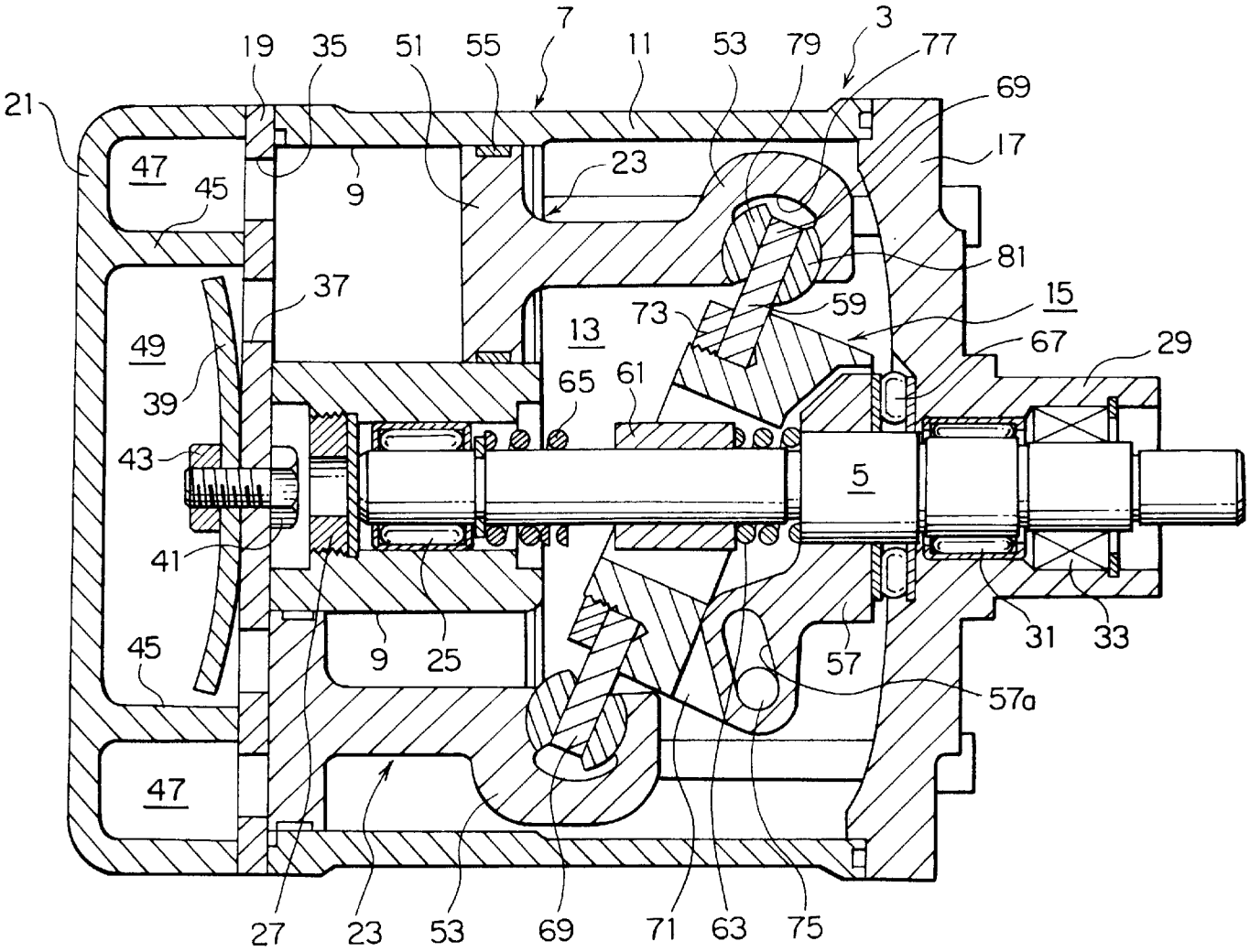
FIG. 1 is a cross-sectional view of a swash plate type variable-capacity compressor according to the present invention.

Referring to FIG. 1, a swash plate type variable-capacity compressor 3 has a drive shaft 5 which is rotated by an external drive source (not shown). A cylinder block 7 accepts one end of the drive shaft 5 and is formed with a plurality of cylinder bores 9 which are angularly spaced around the drive shaft 5. The cylinder block 7 is formed integrally with a housing 11 which defines a crank chamber 13 adjacent to the cylinder bores 9 in the housing 11. In the crank chamber 13, a swash plate assembly 15 is positioned around the drive shaft 5. The other end of the drive shaft 5 protrudes through a front head plate 17 which seals one end of the housing 11. The other end of the cylinder block 7 is attached with a valve plate unit 19. This unit 19 is covered with a cylinder head 21.

Piston members 23 are slidably fitted in the cylinder bores 9 with piston rods project from the cylinder bores 9 into the crank chamber 13.

A bearing 25 is mounted in the cylinder block 7 at a center of the plurality of the cylinder bores 9 and supports one end of the drive shaft 5. A shaft position adjusting threaded member 27 is threaded into the cylinder block 7 so as to abut the one end of the drive shaft 5.

Another bearing 31 is mounted in a cylindrical protrusion 29 of the front head plate 17 and supports the other end of the drive shaft 5. A sealing member 33 is positioned outside the bearing 31 in series therewith in a direction of the length of the drive shaft 5 to hermetically seals the crank chamber 13.

The valve plate unit 19 has suction holes 35 and discharge holes 37, all of which communicate with the inside of the cylinder bores 9. the valve plate unit 19 has suction valves and discharge valves (not shown) which operatively close the suction holes at a side of the cylinder bore 9 and the discharge holes 37 at a side of the cylinder head 21. By the use of bolts 41 and nuts 43, a valve retainer 39 is secured to the valve plate unit 19 at a side of the cylinder head 21 to adjust the travel of the discharge valves when they open the discharge holes 37.

In the cylinder head 21, a suction chamber 47 and a discharge chamber 49 are defined and separated by a partitioning wall 45 therebetween. The suction chamber 47 and the discharge chamber 49 can selectively communicate with cylinder bores through the suction holes 35 and the the discharge holes 37 opened by the suction valves and the discharge valves, respectively. The discharge chamber 49 further substantially communicates with the crank chamber 13 through small holes or the like.

Each of the piston members 23 is made of an aluminum alloy and consists of a piston body 51 and the piston rod 53, both of which are integrated with each other. The piston body 51 reciprocates along the drive shaft 5 in the cylinder bore 9. The piston rod 53 extends from the piston body 51 into the crank chamber 13. A piston ring 55 is disposed around the piston body 51.

A swash plate driver 57 is fixedly mounted or secured on the drive shaft 5, so that the swash plate driver 57 is rotatable together with the drive shaft 5. The swash plate driver 57 is provided with an engagement slot 57*a* for engaging with the swash plate assembly 15 as will be described later. A thrust bearing 67 is disposed between the swash plate driver 57 and an inner surface of the front head plate 17 so as to rotatably support the swash plate driver 57 on the front head plate 17.

A cylindrical body 61 is disposed on the middle portion of the drive shaft 5. There are two coil springs 63 and 65 fitted onto the drive shaft at opposite sides of the cylindrical body 61. The coil spring 63 is compressed between the one end of the cylindrical body 61 and a collar of the drive shaft on which the swash plate driver 57 is mounted. The other coil spring 64 is compressed between the other end of the cylindrical body 61 and the bearing 25. Thus, the cylindrical body 61 is elastically positioned on the drive shaft 5 by the opposite coil springs 63 and 65.

The swash plate assembly 15 is engaged with the swash plate driver 57, so that the swash plate assembly 15 is rotatable together with the swash plate driver 57 and the drive shaft 5 as well as swingable about an engaging portion.

The swash plate assembly 15 comprises a flat swash plate member 59 with a center hole and a ring-like support 71 onto which the swash plate member 59 is fitted and fixed by a threaded ring 73. The support 71 is provided with an engagement crank pin 75 which is, in turn fitted into the engagement slot 57*a* in the swash plate driver 57. It should be noted that the drive shaft 5 extends through a center hole of the ring-like support 71 as well as the cylindrical body 61 is also located in the center hole of the support 71. The engagement crank pin 75 and the engagement slot 57*a* make a hinge. Therefore, the the swash plate assembly 15 is swingable about the engagement crank pin 75 and is also rotatable together with the swash plate driver 57. It will be noted that the center hole of the support 71 is larger than an outer diameter of the cylindrical body 61 sufficiently to permit the support 71 to swing about the engagement crank pin 75.

The piston rod 53 is formed with a recess 77 receiving first and second shoes 79 and 81 therein, which shoes are disposed opposite sides of the peripheral edge portion 69 of the swash plate member 59 to hold the peripheral edge portion 69. Thus, the piston rod 53 is coupled to the swash plate member 59.

Each of the first and second shoes 79 and 81 is made of an iron-based alloy such as the bearing steel, and has a shape defined by a flat surface and a generally half-spherical surface. The flat surface is brought into slidable contact with one surface of the peripheral edge portion 69 of the swash plate member 59 and the generally half-spherical surface is brought into slidable contact with the internal surface of the recess 77, as shown in the figure.

The swash plate assembly 15 is disposed so that the swash plate member 59 is inclined with a slant angle. The plurality of pistons 23 are coupled with different positions of the peripheral edge portion 69 of the swash plate member 59. Therefore, the plurality of pistons 23 are disposed at different phases of the reciprocating motion, as shown in the figure.

The swash plate member 59 is made of a Cu-Mn-Si-Zn high-strength brass alloy. The Cu-Mn-Si-Zn high-strength brass alloy not only provides the swash plate member 59 with a sliding property comparing with or superior to those of the conventional swash plate of iron alloy having the copper-based bearing alloy coat as described in the preamble.

As is obvious from Table below, the Cu-Mn-Si-Zn high-strength brass alloy increases the inertia of the swash plate member 59 because of its large specific gravity. Bronze alloy, lead-bronze alloy, or common high-strength brass alloy can also be used for the swash plate member 59.

Figure 2:
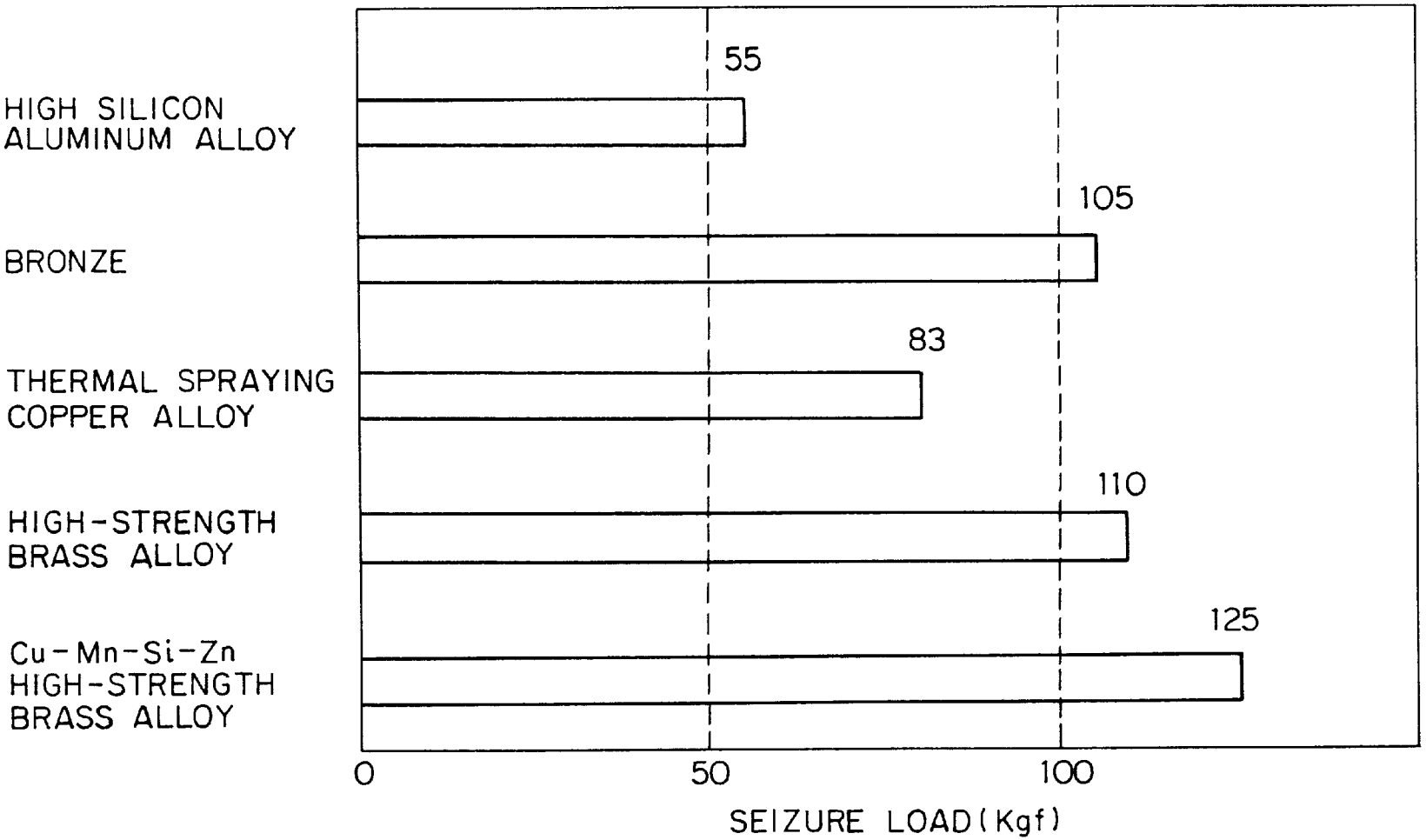
FIG. 2 shows the results of seizure load tests for different materials of the swash plate in the swash plate type variable-capacity compressor of FIG. 1.

Referring to FIG. 2, the Cu-Mn-Si-Zn high-strength brass alloy is seen to provide a better sliding property than common high-strength brass alloys.

TABLE

| METAL | SPECIAL GRAVITY (g/cm$^3$) |
|---|---|
| Aluminum (Al) | 2.8 |
| Iron (Fe) | 7.8 |
| Bronze | 8.8 |
| Lead bronze | 9.0 |
| High-strength brass alloy | 8.2 |
| Cu—Mn—Si—Zn high-strength brass alloy | 8.2 |

In the swash plate type variable-capacity compressor arranged as described above, rotation of the drive shaft 5 rotates the swash plate driver 57 together with the swash plate assembly 15. Since the swash plate member 59 is inclined to the drive shaft 5 and also pistons 23, the pistons 23 is reciprocated by the rotation of the swash plate together with the drive shaft 5. Accordingly, the piston bodies 51 reciprocate in the cylinder bores 9 to cause the refrigerant to be taken into the cylinder bores from the suction chamber 47 through the suction holes 35, then compressed and discharged into the discharge chamber 49 through the discharge holes 37.

In the swash plate type variable-capacity compressor, the compressing capacity is varied by controlling the inner pressure in the crank chamber 13 (which will be referred to as "crank chamber pressure"). If the crank chamber pressure is increased higher than a pressure in the suction chamber (which will be referred to "suction pressure"), the piston backup pressure increases to reduce the piston reciprocating stroke. That is, the slant angle of the swash plate 59 is reduced. On the contrary, when the crank chamber pressure is small in comparison with the suction pressure, the piston backup pressure is small so that the slant angle of the swash plate 59 is increased. This is insured that the swash plate assembly 15 is swingably coupled to the swash plate driver 57 through the hinge mechanism.

Considering that the shoe 79/81 and the swash plate 59 are heated due to friction by the sliding contact therebetween and are seized to each other by the heat, a test described below were carried out so as to verify the effects of the present invention.

The test is to measure a load applied to the shoe and the swash plate to be in contact with each other when the shoe and the swash plate are seized by heat.

Actually, the test was performed at a swash plate rotation speed of 2450 rpm, and an oil flow rate of 82 ml/min. fed to the contact surface between the shoe and the swash plate, by gradually increasing the load to the maximum load of 125 kg. A seizure load was defined as a value of load which was measured when a test piece reached 250° C. by friction. The test was repeated to test pieces of various kinds of alloy as the swash plate. The result is shown in FIG. 2.

It will be understood from the result that the seizure load is high as 100 kgf or more, in the bronze alloy, high-strength brass alloy, and Cu-Mn-Si-Zn high-strength brass alloy in comparison with high silicon aluminum alloy and thermal spraying copper alloy.

The present invention has been described in connection with a swash plate type variable capacity compressor but is not restricted thereto. The present invention is applicable to a swash plate type compressor with a fixed capacity where the slant angle of the swash plate is fixed.

As described above, the present invention provides a swash plate type compressor having a prolonged life time and reduced cost with the number of production steps also reduced.

What is claimed is:

1. A swash plate type compressor which includes a piston with a piston rod and a piston driving mechanism, said piston driving mechanism comprising a drive shaft, a swash plate inclined with a slant angle on said drive shaft and rotated together with the drive shaft, and sliding shoes coupling said swash plate to said piston rod so as to reciprocate said piston by rotation of said swash plate, wherein said swash plate is made throughout of a copper alloy.

2. The swash plate type compressor as claimed in claim 1, wherein said copper alloy is at least one selected from a high-strength brass alloy, a bronze alloy, and a lead-bronze alloy.

3. The swash plate type compressor as claimed in claim 1, wherein said copper alloy is a wear-resistant high-strength brass alloy.

4. The swash plate type compression as claimed in claim 3, wherein said wear-resistant high strength brass alloy is a Cu-Mn-Si-Zn high-strength brass alloy.

5. The swash plate type compressor as claimed in claim 1, which is a variable capacity one wherein said swash plate is coupled to said drive shaft to be swingable about a coupling portion as well as rotatable together with said drive shaft, said swash plate is thereby controllable in its slant angle.

* * * * *